US006130694A

United States Patent [19]

Beatty

[11] Patent Number: 6,130,694

[45] Date of Patent: Oct. 10, 2000

[54] REGULATOR ASSEMBLY FOR MODULATING FLUID PRESSURE WITHIN AN INK-JET PRINTER

[75] Inventor: Christopher C. Beatty, Corvallis, Oreg.

[73] Assignee: Hewlett-Packard Company, Palo Alto, Calif.

[21] Appl. No.: 08/648,238

[22] Filed: May 13, 1996

[51] Int. Cl.[7] ..... B41J 2/175

[52] U.S. Cl. ..... 347/85

[58] Field of Search ..... 347/85, 86, 87, 347/1; 137/907, 505.41

[56] References Cited

U.S. PATENT DOCUMENTS

| | | | |
|---|---|---|---|
| 3,371,350 | 2/1968 | Sanderson et al. . | |
| 4,677,447 | 6/1987 | Nielsen | 347/87 |
| 5,129,794 | 7/1992 | Beatty . | |
| 5,171,132 | 12/1992 | Miyazaki et al. | 417/413 |
| 5,457,485 | 10/1995 | Moriyama et al. . | |
| 5,524,592 | 6/1996 | Woody et al. | 137/907 |
| 5,764,258 | 6/1998 | Hetzer et al. | 347/85 |

FOREIGN PATENT DOCUMENTS

| | | |
|---|---|---|
| 0 709 207 | 5/1996 | European Pat. Off. . |

*Primary Examiner*—N. Le
*Assistant Examiner*—Judy Nguyen

[57] ABSTRACT

A regulator assembly is incorporated within an ink-jet pen for regulation of ink pressure within the pen. The regulator assembly comprises an ink delivery chamber and an ink control chamber wherein regulation of the ink pressure is effectuated by the response of a deformable diaphragm located within the ink control chamber, to ink pressure changes within the pen.

4 Claims, 4 Drawing Sheets

REGULATOR ASSEMBLY FOR MODULATING FLUID PRESSURE WITHIN AN INK-JET PRINTER

FIELD OF THE INVENTION

The present invention relates to a device for precisely controlling fluid pressure within a fluid passageway, including controlling fluid pressure within an ink-jet printhead or gas chromatograph.

BACKGROUND

An ink-jet printer includes a pen in which small droplets of ink are formed and ejected toward a printing medium. The pen is mounted to a reciprocating carriage in the printer. Such pens include printheads with orifice plates having very small nozzles through which ink droplets are ejected. Adjacent to the nozzles are ink chambers where ink is stored prior to ejection. Ink is delivered to the ink chambers through ink channels that are in fluid communication with an ink supply. The ink supply may be, for example, contained in a reservoir section of the pen or supplied to the pen from a remote site.

Ejection of an ink droplet through a nozzle may be accomplished by quickly heating a volume of ink within the adjacent ink chamber. The thermal process causes ink within the chamber to superheat and form a vapor bubble. Formation of a thermal ink-jet vapor bubble is known as "nucleation." The rapid expansion of ink vapor forces a drop of ink through the orifice. This process is called "firing." Ink in the chamber may be heated, for example, with a resistor that is responsive to a control signal. The resistor is aligned adjacent the nozzle.

Ink-jet printers are affected by fluid pressure changes within the printer system. An undesirably high fluid pressure may cause ink to flow uncontrollably to the printhead, subsequently forcing ink through the nozzles. Ink leakage through the printhead nozzles is known as drooling.

Irrespective of whether there is a substantial increase in fluid pressure within the printer, it is desirable to establish a slight back pressure within the system. The presence of a back pressure ensures ink is expelled only when the printhead is activated (i.e., when ink is fired). As used herein, the term "back pressure" means a partial vacuum within the printhead. Back pressure is considered in the positive sense, so that an increase in back pressure represents an increase in the partial vacuum. Accordingly, the back pressure is measured in positive terms, such as water column height.

Although previous ink-jet pens have incorporated a pressure regulator on the pen, these regulators were large and heavy causing a decrease in print speed. Thus, conventional ink-jet pens are sometimes regulated with an off-axis regulator. That is, inkjet pen regulators are located at a site remote of the reciprocating carriage to which the pen is mounted.

SUMMARY OF THE INVENTION

The present invention provides a system for controlling fluid pressure within an ink-jet printhead. In a preferred embodiment of the present invention, fluid pressure within the printhead is controlled by a regulator assembly affixed to or integral with a printhead of an ink-jet pen.

The regulator assembly is connected to an ink channel defined by the printhead, the regulator assembly being interposed between an ink supply and an ink firing chamber.

In accordance with a preferred embodiment of the present invention, a regulator assembly comprises an ink delivery chamber with an ink inlet in fluid communication with an ink supply and an ink control chamber having an ink outlet in fluid communication with the ink firing chambers.

The regulator assembly is activated by fluid pressure changes within the printhead or ambient pressure. The regulator assembly operates to maintain the amount of back pressure below a level that would otherwise cause the printhead to fail and above a level that would cause the printhead to drool. The regulator is relatively small and light, such that the regulator may be incorporated within the ink-jet pen without reducing print speed. Additionally, locating the small regulator within the printhead of the pen provides a relatively quick response to pressure changes in the pen with a high volumetric efficiency.

The preferred embodiments of the present invention may be micromachined, providing low cost, wafer-based batch processing, repeatability and a relatively light and small fluid pressure regulator device that is readily affixed to an ink-jet pen.

DESCRIPTION OF PREFERRED EMBODIMENTS

Figure 1:
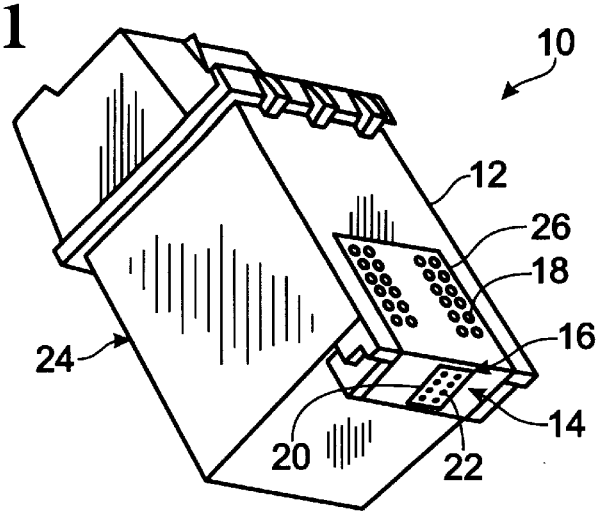
FIG. 1 is a perspective view of an ink-jet printer pen that includes a preferred embodiment of the printhead regulator assembly.

Referring to FIG. 1, the regulator assembly of the present invention is incorporated within an ink-jet printer pen 10. The pen includes a pen body 12 defining a reservoir 24. The reservoir 24 is configured to hold a quantity of ink. A printhead 20 is fit into the bottom 14 of the pen body 12 and controlled for ejecting ink droplets from the reservoir 24. The printhead 20 defines a set of nozzles 22 for expelling ink, in a controlled pattern, during printing. Each nozzle 22 is in fluid communication with a firing chamber 32 defined in the base of printhead 20 (FIG. 2).

A supply conduit (not shown) conducts ink from the reservoir 24 to ink channels 28*a* and 28*b*, defined by the printhead. The ink channels are configured so that ink moving therethrough is in fluid communication with each firing chamber 32 (FIG. 2).

Figure 2:
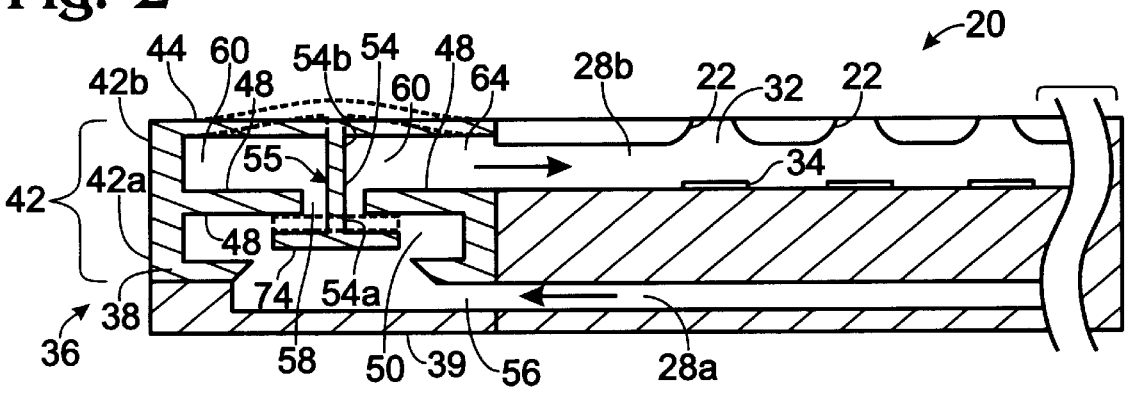
FIG. 2 is an enlarged, cross-sectional, partial view of a printhead that includes a preferred embodiment of the regulator assembly.

Each firing chamber 32 has associated with it a thin-film resistor 34 (FIG. 2). The resistors 34 are selectively driven (heated) by current applied by an external microprocessor and associated drivers. Conductive drive lines to each resistor 34 are carried upon a flexible circuit 26 mounted to the exterior of the pen body 12 (FIG. 1). Circuit contact pads 18 (shown enlarged for illustration) at the ends of the resistor drive lines engage similar pads carried on a matching circuit attached to the carriage (not shown).

Regulator assembly 36 is affixed to printhead 20 of ink-jet pen 10 (FIG. 2). More particularly, regulator assembly 36 is connected to the printhead ink channels 28*a* and 28*b*. The regulator assembly 36 is located between an ink supply and the firing chambers 32.

The ink channels define an upstream and downstream ink flow path, respectively, relative to the regulator assembly. The ink channels comprise a continuous pathway for ink flowing from an ink supply to the firing chamber. More particularly, an ink supply within the pen reservoir 24, or at a site remote of the pen 10, is in fluid communication with ink channel 28*a*.

In a preferred embodiment of the present invention, the regulator assembly 36 generally comprises a bottom plate 39, a spacer wall 42 and a partition plate 48, together defining an ink delivery chamber 50 having an ink inlet 56 (FIG. 2). Regulator assembly 36 further includes a deformable diaphragm 44 having a sealing member, preferably in the form of an integrally connected T-shaped plunger member 55 that extends into the ink delivery chamber 50. The plunger member 55 may comprise a shaft 54 having a flanged end 74. The shaft 54 would extend through an ink passageway 58 formed in partition plate 48. The diaphragm 44, spacer wall 42, and partition plate 48 define an ink control chamber 60 having an ink outlet 64.

Bottom plate 39 forms a lower surface of ink delivery chamber 50 (FIG. 2). Spacer wall 42, includes a first or lower portion 42*a* and a second or upper portion 42*b*. The wall 42 is affixed to the periphery of a flat substrate 38 and extends substantially perpendicular to the substrate. Substrate 38 is affixed to bottom plate 39. Spacer wall 42 defines the side walls of the ink delivery chamber 50 and the side walls of the ink control chamber 60.

It will be appreciated that regulator assembly 36 may be oriented in an ink-jet printer in a variety of positions. Thus, for example, although bottom plate 39 is described as defining a lower surface of ink delivery chamber 50, that plate may effectively define an upper surface, depending upon the orientation of the ink-jet pen printhead.

In a preferred embodiment, partition plate 48 joins the spacer wall 42 at about the midpoint thereof, and extends across the length of the ink delivery chamber 50. Partition plate 48 extends substantially parallel to substrate 38 and perpendicular to spacer wall 42, thereby defining both the upper surface of ink delivery chamber 50 and the lower surface of the ink control chamber 60.

A narrow ink passageway 58 is formed through partition plate 48 at about the midpoint thereof. Ink may flow from ink delivery chamber 50, through ink passageway 58 and into ink control chamber 60.

The resiliently deformable membrane 44 covers the ink control chamber 60 and is affixed to upper spacer wall 42b. Deformable membrane 44 is positioned substantially parallel with partition plate 48 and perpendicular to spacer wall 42. The outermost portion of deformable membrane 44 is attached to the spacer wall 42 such that partition plate 48, spacer wall 42b and deformable membrane 44 define the ink control chamber 60.

The T-shaped plunger member 55 is integrally connected to the deformable diaphragm 44 at the upper end 54*b* of the plunger member shaft 54. The junction between the first or upper end 54*b* of shaft 54 and the deformable diaphragm 44 is aligned directly above ink passageway 58 (FIG. 2). The shaft 54 preferably extends substantially perpendicular to diaphragm 44. A second or lower end 54*a* of plunger member shaft 54 extends through ink passageway 58 to terminate within ink delivery chamber 50.

The end 74 of plunger member 55 is integrally formed at the second end 54*a* of shaft 54. End 74 is preferably perpendicular to shaft 54 and extends substantially parallel with partition plate 48. It will be appreciated that end 74 is at least slightly larger than the ink passageway 58 so that ink flow is effectively reduced as end 74 is brought into contact with partition plate 48 as explained below.

In a preferred embodiment of the present invention, ink flows through ink channel 28*a*, ink inlet 56 and into ink delivery chamber 50. When plunger member 55 is in an open position (FIG. 2), ink flows from the ink delivery chamber 50, through passageway 58, into the ink control chamber 60. From the control chamber 60, ink flows through ink outlet 64, into ink channel 28*b* and to the ink firing chambers 32.

Ink flows through the printhead due to capillary forces present within the channel 28*b*, but may also flow due to other forces such as, for example, gravitational force or pressure from a pressurized ink supply.

Regulator assembly 36 passively regulates the fluid ink pressure within the printhead 20, such that a preselected, slightly positive back pressure is maintained. Regulation of the back pressure is effectuated by response of the deformable diaphragm 44 to fluid pressure changes within the ink control chamber 60.

More specifically, as fluid pressure within ink control chamber 60 increases, diaphragm 44 is deformed in a direction away from partition plate 48. As the diaphragm is deformed upwardly, end 74 of the plunger member 55 is moved toward partition plate 48. As end 74 approaches partition plate 48, ink flow from ink delivery chamber 50 to ink control chamber 60 is reduced because the end 74 increasingly blocks the passageway 58.

As ink pressure within ink control chamber 60 increases, the diaphragm continues to deform, moving end 74 toward partition plate 48 until that end 74 and partition plate 48 join to create a seal, thereby preventing passage of ink from the ink delivery chamber 50 into the ink control chamber 60 (i.e., the regulator is in a closed position, as shown in dashed lines in FIG. 2). Consequently, ink flow from ink control chamber 60 through ink outlet 64 to the firing chambers 32 is reduced or terminated.

As ink is ejected from the firing chamber 32, ink flows from ink channel 28*b* to refill the firing chamber, and the attendant ink flow from control chamber 60 decreases fluid pressure within the control chamber. As fluid pressure within ink control chamber 60 decreases, deformable diaphragm 44 deflects toward partition plate 48. As the diaphragm deflects, end 74 moves in a direction away from partition plate 48 and ink flows freely from ink delivery chamber 50 through ink passageway 58 to control chamber 60 (i.e., the regulator is in an open position).

As ink flows from delivery chamber 50 to control chamber 60, the fluid pressure in the control chamber increases. As fluid pressure increases, the diaphragm 44 is again deformed from the partition plate, as discussed above. The regulator assembly is constructed to respond to pressure changes such that the ink fluid pressure is maintained at a preselected, slightly positive back pressure, relative to ambient pressure, within the channel 28*b*.

The diaphragm 44 of the regulator assembly 36 also deflects in response to ambient pressure changes to regulate ink flow within control chamber 60 as just described.

The fluid pressure regulation within the printhead by regulator assembly 36 is primarily a function of the geometry of the plunger member 55 relative to the partition plate 48 (i.e., the distance between end 74 and partition plate 48), the volume of ink chambers 50 and 60, and the flexibility of the regulator assembly 36 materials. Particularly, the flexibility of deformable diaphragm 44 plays a primary role in determining the level at which the printhead back pressure will be maintained.

The thickness and rigidity of material used for the deformable diaphragm 44 determine its flexibility. A more rigid diaphragm requires a greater pressure change to effect a change in position of the diaphragm and subsequently increase or decrease the ink flow from the ink delivery chamber 50 to the control chamber 60.

Although regulator assembly 36 has been described for use within an ink-jet printer, the regulator assembly may be used in a variety of areas of industry and engineering for precise pressure control of both liquids and gases. For example, such a regulator may be used to control the flow of carrier and detector gases in gas chromatography instrumentation where constant fluid pressure is essential to the operation of the instrument.

A preferred embodiment and fabrication process for the regulator assembly 36 generally provides a plated metallic regulator assembly.

Referring to FIGS. 4*a*–4*d*, a fabrication process is provided for the preferred embodiment illustrated in FIG. 2. A substrate 38 comprises a conventional IC (integrated circuit) silicon wafer. The substrate is uniformly coated with a silicon nitride layer 86, preferably about 800 Å to 1 mm in thickness. The silicon nitride layer 86 is applied using conventional LPCVD (low pressure chemical vapor deposition) techniques.

On a front side 84 of substrate 38, a thin bonding layer 88, preferably comprising copper or titanium, is deposited by conventional sputtering processes. Thin layer 88 functions as a bonding layer between the silicon nitride layer 86 and the later deposited, lower spacer wall 42*b* and plunger member end 74. Layer 88 also provides a "seed" layer for the metal plating process following. Bonding layer 88 is, preferably, about 1000 Å in thickness.

Following deposition of bonding layer 88, a photoresist layer 92 is deposited and patterned to define lower spacer wall 42*a* and plunger member end 74. In a preferred embodiment, both lower spacer wall 42*a* and end 74 comprise nickel, deposited by conventional electroforming or electroplating techniques but may also comprise gold, iron, or any other electrodeposited material.

Figure 4A:
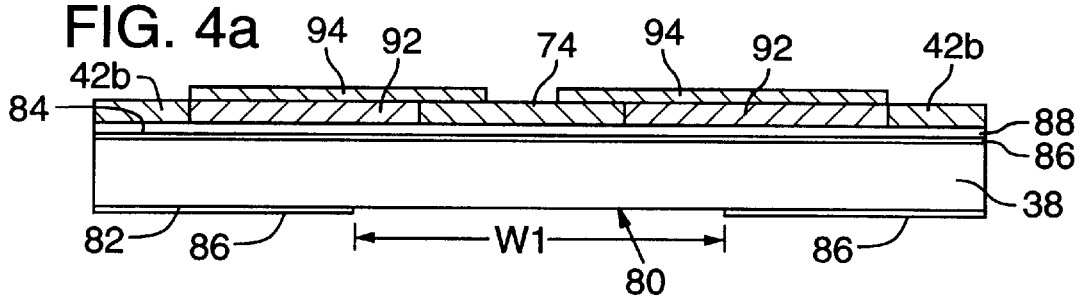
FIGS. 4*a–d* depict the sequence of steps for fabricating the regulator assembly of FIG. 2.

An opening 80 is patterned on the backside 82 of substrate 38 (FIG. 4*a*). Preferably, opening 80 is about 1 mm in length (designated "W1" in FIG. 4*a*). A plasma etchant, such as $CF_4$ (carbon tetra fluoride), is used to remove the exposed silicon nitride layer on the backside 82 of substrate 38. A section of the substrate 38 is then exposed by removal of the silicon nitride layer. Remaining photoresist is then removed.

Figure 4B:
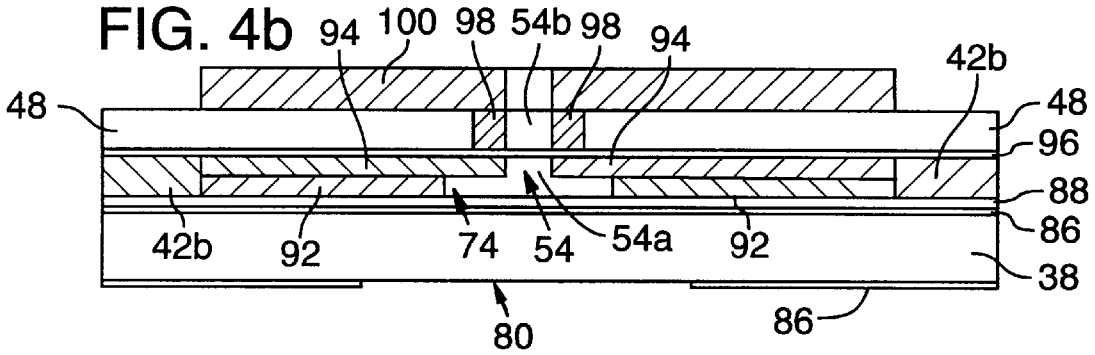

A second layer of photoresist 94 is patterned onto first photoresist layer 92 and onto a portion of end 74, leaving the centermost portion of end 74 exposed (a length of about 50 mm) to define the width of the lower portion 54*a* of shaft member 54 (FIGS. 4*a* and 4*b*). Portion 54*a* of the shaft is then applied, preferably comprising nickel deposited by conventional electroplating techniques (FIG. 4*b*). A second uniform, thin layer 96, of about 1000 Å in thickness, is next deposited. Preferably, the second thin layer 96 comprises copper or titanium deposited by sputtering processes. The second thin layer 96 acts as both a bonding or adhesion layer and as a seed layer.

A third layer of photoresist 98 is deposited and patterned to define the partition plate 48 (FIG. 4*b*) and a continuation of shaft 54 of the plunger member 55 (FIG. 2). The partition plate 48 and shaft 54 preferably comprise nickel deposited by electroplating techniques.

Figure 4C:
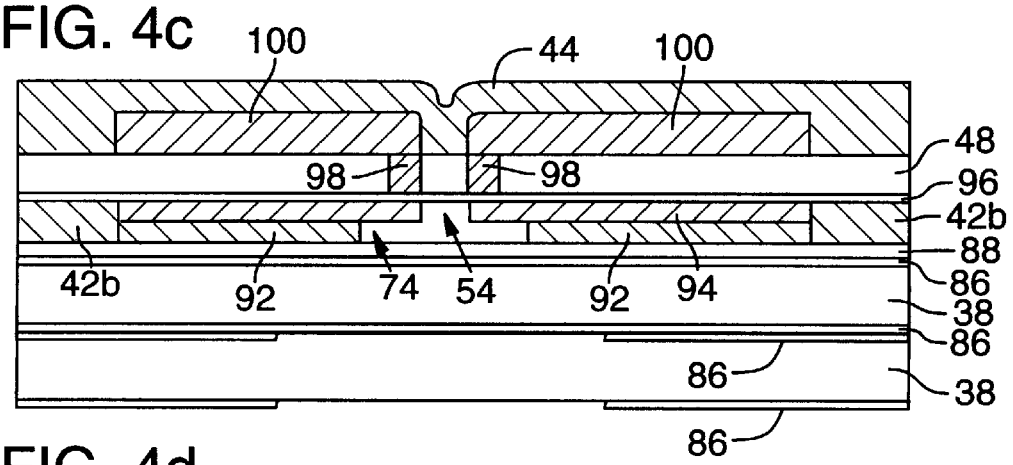

A fourth layer of photoresist 100 is patterned to define what will be ink control chamber 60. On photoresist 100 is deposited deformable membrane 44 (FIGS. 4*b* and 4*c*). Photoresist layer 100 does not extend to the perimeter of regulator assembly 36 and does not cover shaft 54 of the plunger member 55. These areas are left exposed to connect the deformable diaphragm 44 to both the shaft 54 of the plunger member 55 and perimeter of partition plate 48.

Deformable diaphragm 44, preferably comprising electroplated or sputter deposited materials, such as nickel, is applied to photoresist layer 100 and shaft 54. In this way, the shaft is integrally connected to the diaphragm 44 (FIG. 4*c*). The diaphragm is preferably about 1–10 mm in thickness.

Figure 4D:
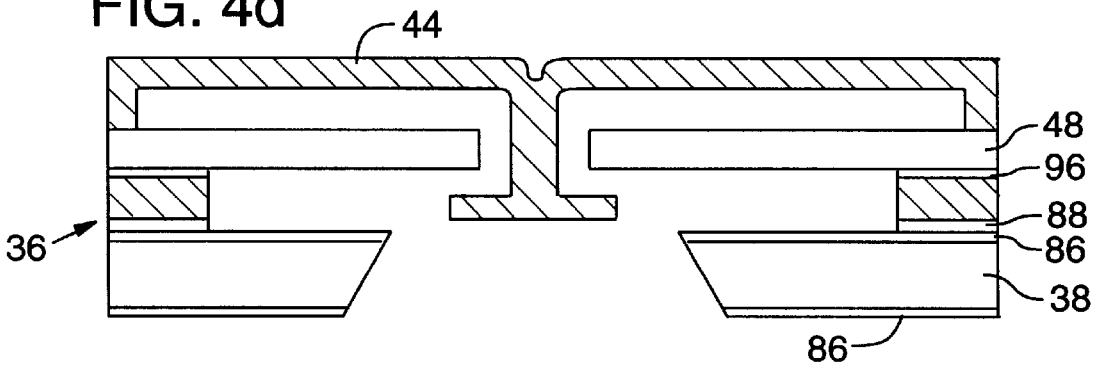

The silicon wafer substrate 38 is next anisotropically etched from backside opening 80. Anisotropic etching produces a sloped edge in the silicon substrate 38 (FIG. 4*d*). The silicon substrate 38 is etched through to the upper silicon nitride layer 86 with KOH, hydrazine or TMAH (tetramethylammonium hydroxide), or other suitable etchants. The exposed portion of the silicon nitride layer 86 is then removed using a plasma etchant such as $CF_4$ or $SF_6$ (FIG. 4*d*).

Finally, photoresist layers 92, 94, 98, 100 and exposed regions of seed films 88 and 96 are removed (FIG. 4*d*).

Following removal of the photoresist layers, ink outlet 64 is formed through the upper portion 42*b* of spacer wall 42 so that ink may flow from ink control chamber 60 to ink channel 28*b* (best shown in FIG. 2). Ink outlet 64 is preferable formed using conventional sawing techniques. Alternatively, ink outlet 64 may be formed during the fabrication process by patterning such, prior to applying the deformable diaphragm 44 layer. Ink inlet 56 is formed when the regulator assembly is affixed to the printhead. The inlet is an opening between the bottom plate (FIG. 2) and the regulator substrate 38 (FIGS. 2 and 4*d*).

Regulator assembly 36 of the above described preferred embodiment is then bonded to an ink-jet pen using conventional adhesives. The regulator assembly 36 is affixed to printhead 20 such that ink channels 28*a* and 28*b* of the printhead are aligned with ink inlet 56 and ink outlet 64 of the regulator, respectively.

Figure 5A:
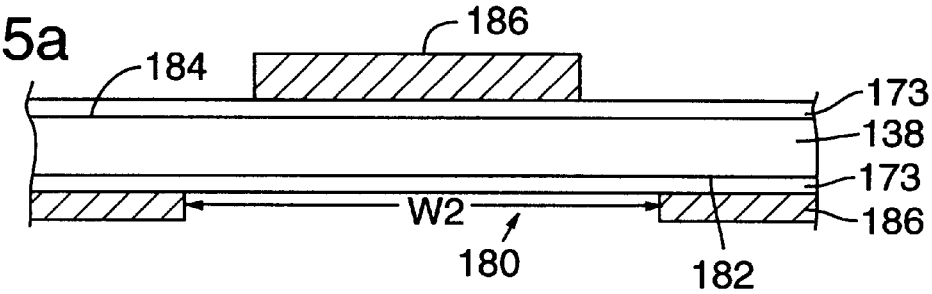
FIGS. 5*a–e* depict an alternative fabrication process for manufacturing the regulator assembly of FIG. 2.

An alternative method of fabricating the preferred embodiment of the regulator assembly of FIG. 2 starts with a conventional silicon wafer. Referring to FIGS. 5*a*–*e*, the wafer, also referred to as substrate 138, is coated on both sides with a LPCVD silicon nitride layer 173, preferably, about 800 Å to 1 mm in thickness. A plunger member end 174 is patterned on the front side 184 of substrate 138, by partially covering silicon nitride layer 173 with photoresist layer 186 (FIG. 5*a*). An opening 180 is also patterned with photoresist on backside 182 of substrate 138. Preferably, opening 180 is about 1 mm in length (depicted as "W2" in FIG. 5*a*).

A plasma etchant, such as $CF_4$, is used to remove the exposed portion of the silicon nitride layer 173 on the front side 184 of the substrate and to partially remove a significant portion of the exposed silicon nitride layer 173 on the backside 182 of the substrate, such that the backside of substrate 138 remains partially covered with silicon nitride. Photoresist layer 186 is then removed. The portion of layer 173 remaining on the front side 184 becomes the plunger member end 174 (FIG. 5*b*).

Figure 5B:
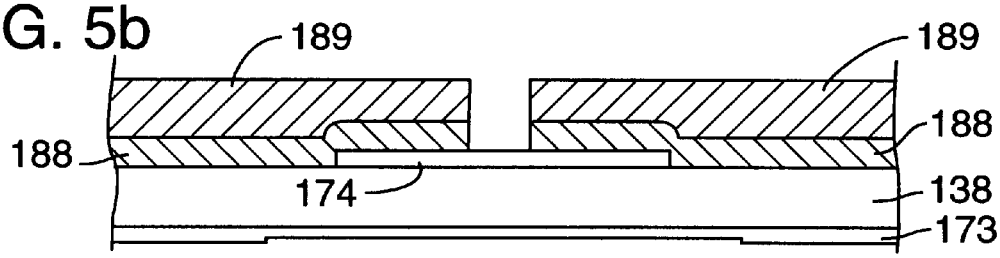

A first sacrificial layer 188, preferably comprising LPCVD or PECVD silicon dioxide, is applied to the front side 184 of substrate 138, uniformly covering plunger member end 174 and the exposed portion of the front side of substrate 138 (FIG. 5*b*). The first sacrificial layer 188 is preferably about 2 mm in thickness, and defines what will be the ink delivery chamber 50 (FIG. 2). What will become a lower portion 54*a* of a shaft 54 (FIG. 2) is then patterned through application of photoresist layer 189 and removal of the exposed portion of sacrificial layer 188 (FIG. 5*b*). Photoresist layer 189 is then removed.

Figure 5C:
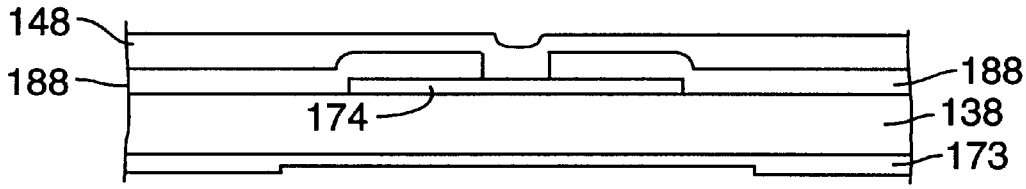

A thin film layer 148, preferably comprising a LPCVD polysilicon about 2 mm in thickness, is uniformly applied to cover sacrificial layer 188 and the exposed portion of plunger member end 174 (FIG. 5*c*). Layer 148 may also comprise other compounds such as, silicon nitride. Layer 148 forms what will be the partition plate 48 (FIG. 2). Polysilicon layer 148 is patterned and etched, exposing a portion of layer 188 and a portion of end 174 to define ink passageway 158 (FIG. 5*d*).

Figure 5D:
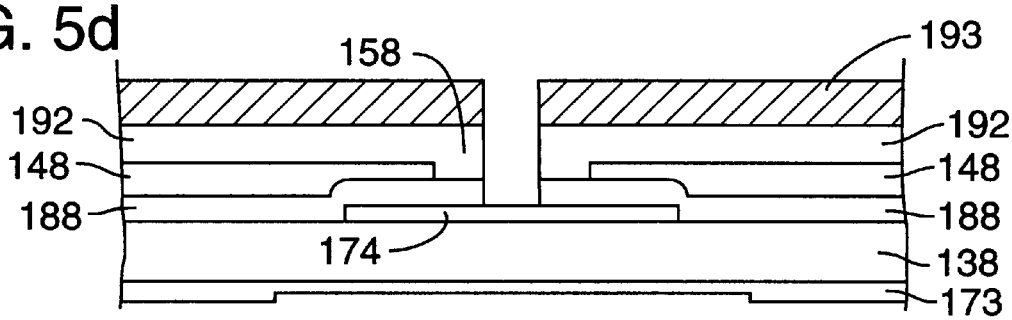

A second sacrificial layer 192, preferably LPCVD or PECVD silicon dioxide, is applied uniformly over layer 148 and the exposed portions of layer 188 at a thickness of about 2–10 mm (FIG. 5*d*). Sacrificial layer 192 is then patterned with photoresist layer 193 and etched to define what will be the shaft 54 (FIG. 2), leaving a portion of end 174 exposed. Photoresist layer 193 is then removed.

Figure 5E:
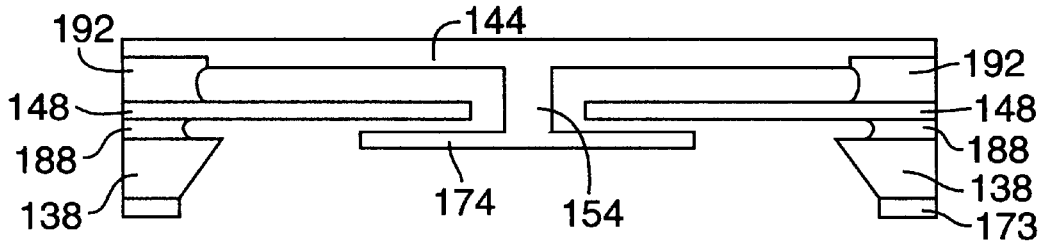

Thin layer 144 is deposited conformably over layer 192 and the exposed portion of end 174 (FIG. 5*e*). Layer 144 (FIG. 5*e*) forms the deformable diaphragm 44 and the shaft 54 (FIG. 2). Thin layer 144 preferably comprises LPCVD silicon nitride. The radius of shaft 154 is about 10–100 mm.

The remaining silicon nitride layer 173 on the backside 182 of substrate 138 is etched to expose a portion of substrate 138. Substrate 138 is then isotropically etched, preferably, with KOH, hydrazine or TMAH (FIG. 5*e*). Lastly, the first sacrificial oxide layer 188 and the second sacrificial oxide layer 192 are time-etched. The time-etching leaves the periphery of layers 188 and 192 (FIG. 5*e*) to form lower spacer wall 42*b* of the ink delivery chamber 50 and upper spacer wall 42*a* of the ink control 60, respectively (FIG. 2).

The regulator assembly is then aligned with and preferably bonded to the printhead using a conventional adhesive and as discussed above.

Figure 3:
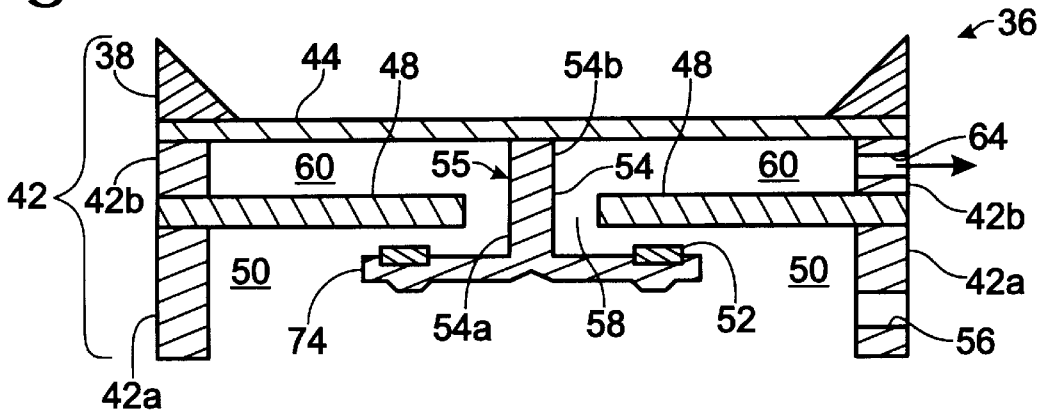
FIG. 3 is an enlarged, cross-sectional view of the regulator assembly in accordance with another embodiment of the present invention.

Another preferred embodiment of the present invention, illustrated in FIG. 3, is fabricated as depicted in FIGS. 6*a*–6*d*. For ease of description, components of the embodiment of FIG. 3 are labeled with the counterpart components of FIG. 2.

The substrate 238 comprises a conventional IC silicon wafer.

The wafer is coated on both the front side 284 and the back side 282 with thin layers 290*a* and 290*b* preferably comprising LPCVD silicon nitride. Each layer 290*a* and 290*b* are preferably about 1 mm in thickness. Other materials, such as silicon dioxide, deposited by PECVD (plasma enhanced chemical vapor deposition) may be used for layers 290*a* and 290*b*.

Figure 6A:
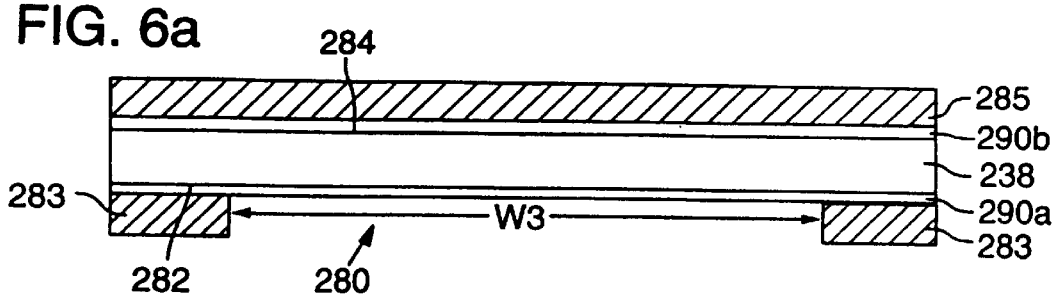
FIGS. 6*a–d* depict the sequence of steps for fabricating the regulator assembly of FIG. 3.

An opening 280 is patterned on the back side 282 of substrate 238 with photoresist layer 283, exposing a portion of silicon nitride layer 290*a* (depicted as "W3" in FIG. 6*a*). The front side 284 of substrate 238 is uniformly coated with photoresist layer 285 (FIG. 6*a*). The exposed portion of silicon nitride layer 290*a* is etched using a plasma etchant such as $CF_4$, that leaves a portion of substrate 238 exposed. Photoresist layers 283 and 285 are then removed.

On the front side 284 of the substrate 238, a thin layer 294 of LPCVD, PFCVD or spin-on silicon dioxide is deposited uniformly over layer 290*b*. Preferably, a doped silicon dioxide is used due to its beneficial, rapid etch time.

A thin layer 248, preferably comprising LPCVD polycrystalline silicon (polysilicon), is deposited at a thickness of about 5 mm to form what will be the partition plate 48 (FIG. 3). Alternatively, LPCVD tungsten or silicon nitride thin-film layers may be used for layer 248.

Figure 6B:
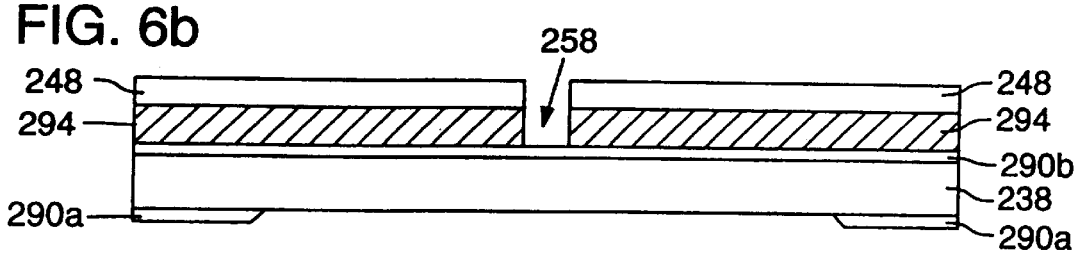

Thin layer 248 is then patterned with photoresist to expose a portion that later will be etched to define opening 258 (FIG. 6*b*). Opening 258 will operate as the ink passageway 58 between the ink delivery chamber 50 (FIG. 3) to the ink control chamber 60 (FIG. 3) in the completed device. The exposed portion of layer 248 is etched down through sacrificial oxide layer 294, stopping at nitride layer 290*b* (FIG. 6*b*).

A second sacrificial oxide layer 273, preferably comprising LPCVD or PECVD silicon dioxide, is deposited, creating a uniform thin-film layer atop polysilicon layer 248. Layer 273 is patterned with sacrificial oxide layer 255 and etched down to layer 290*b* (FIG. 6*c*) to define what will be the shaft 54 (FIG. 3). The shaft radius is preferably about 10–100 mm.

A uniform layer 275, preferably comprising PECVD silicon nitride, is deposited over layer 273.

Figure 6C:
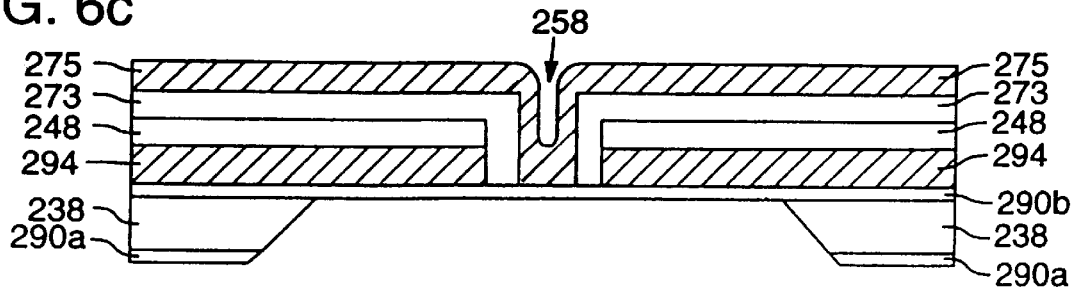

Substrate 238 is then anisotropically etched through opening 280 (FIG. 6*c*). Silicon substrate 238 is etched to silicon nitride layer 290*b* with KOH, hydrazine or TMAH or other etchants that do not etch silicon nitride. Silicon nitride layer 290*b* forms the deformable diaphragm 44 (FIG. 3).

Figure 6D:
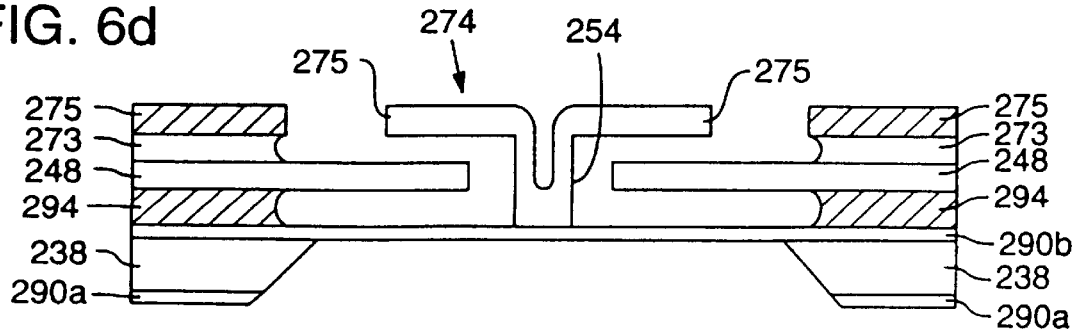

Layer 275 is then patterned and etched to form plunger member end 274 and the end of shaft 254 (FIG. 6*d*). Oxide layers 294 and 273 are then time-etched, leaving the periphery of the layers to form the upper 42*b* and lower 42*a* spacer walls, respectively (FIGS. 6*d* and 3). The regulator device depicted in FIG. 6*d* is inverted, and layer 275 is bonded to a printhead in a manner such as the regulator 36 depicted in FIG. 2.

An ink inlet 56 and an ink outlet 64 are formed through spacer walls 42*b* and 42*a*, respectively, in the manner described above (FIG. 3).

A gasket 52 may be included on plunger member end 74 (FIG. 3). If flow rates are low (e.g., less than about 0.5 cc/min) or the fluid has a low viscosity, gasket 52 may be necessary to sufficiently occlude ink flow from ink delivery chamber 50 to ink control chamber 60.

Fabrication of this gasketed embodiment is identical to the fabrication process described directly above (depicted in FIGS. 6*a*–*d*), with the following additional steps. After layer 273 is deposited, a gasket 52 is patterned with photoresist and then deposited. The gasket 52 preferably comprises polyimide applied using conventional spin-on techniques. Gasket 52 is preferably, approximately 10–30 mm in width.

The plunger member is then patterned with photoresist and deposited as discussed in the fabrication process described immediately above (FIG. 6*d*). It is notable that gasket 52, illustrated in FIG. 3, is not drawn to scale. Because the pressure of the ink supply delivered to the regulator acts upon the surface area of the gasket 52, deformable membrane 44 must be significantly wider than the radius of gasket 52. If deformable membrane 44 is not much wider than the radius of gasket 52, the movement of membrane 44 will be in response to the ink supply pressure rather than in response to fluid pressure changes within the ink-jet printhead.

Having described and illustrated the principles of the invention with reference to preferred embodiments, it should be apparent that the invention can be further modified in arrangement and detail without departing from such principles. For example, the regulator assembly may be used to modulate a pressurized ink system.

What is claimed is:

1. A method for controlling fluid pressure within an ink-jet printhead comprising the steps of:

providing a printhead including an ink channel inside the printhead wherein the ink channel defines a volume through which ink flows, the ink channel in fluid communication with a firing chamber inside the printhead and having a nozzle through which ink droplets are ejected from the printhead;

dividing the channel into two chambers that are joined by a passageway such that ink may flow through the passageway;

affixing to the printhead a plunger that extends through the passageway such that said plunger is moveable between an open position and a closed position wherein the plunger occludes the passageway; and moving the plunger to said open position in response to ambient pressure changes or to pressure changes in one of the chambers such that ink may flow through the passageway and to said closed position such that ink flow through the passageway is restricted.

2. A system for regulating fluid pressure, comprising:

a printhead member that includes a channel through which ink may flow to a nozzle carried by the printhead member; and a regulator assembly affixed to the printhead member and connected to the channel;

the regulator assembly having first and second internal chambers separated by a partition plate that makes up part of the regulator assembly, the partition plate having a passageway through it and disposed so that ink flowing through the channel to the nozzle passes into the first chamber, through the passageway, into the second chamber, and to the nozzle;

the regulator assembly also having a part that comprises a deformable diaphragm spaced from one side of the partition plate;

a plunger member having a first end and a second end wherein the first end is connected to the diaphragm and wherein the plunger member extends through the passageway so that the second end is located within the first chamber; and the diaphragm oriented so that it is responsive to an increase in fluid pressure within the regulator assembly to deform toward a closed position whereby the second end of the plunger member occludes the passageway to restrict ink flow through the passageway, and responsive to a decrease in fluid pressure within the regulator assembly to move the second end toward an open position to facilitate ink flow through the passageway, whereby the increase and decrease in fluid pressure is relative to ambient pressure.

3. The system of claim 2 wherein the second end of the plunger member is movable to contact the partition plate at the passageway and thereby create a seal with the partition plate such that fluid flow through the passageway is occluded.

4. The system of claim 2 further comprising an ink-jet pen to which the printhead member is connected and a reservoir for ink, the reservoir and printhead member connected, and the regulator assembly carried by the ink-jet pen.

* * * * *

UNITED STATES PATENT AND TRADEMARK OFFICE

CERTIFICATE OF CORRECTION

PATENT NO. : 6,130,694
DATED : October 10, 2000
INVENTOR(S) : Christopher C. Beatty It is certified that error appears in the above-identified patent and that said Letters Patent is hereby corrected as shown below:

Title page,
Item [56], U.S. PATENT DOCUMENTS, insert -- 5,259,737 11/1993 Kamisuki et al. 347/1 --

Signed and Sealed this

Eleventh Day of February, 2003

JAMES E. ROGAN
*Director of the United States Patent and Trademark Office*